United States Patent [19]

Hrubec

[11] 4,293,965

[45] Oct. 13, 1981

[54] UNITARY FURNITURE ELEMENT

[76] Inventor: Margaret C. Hrubec, 220 E. 27th St., Apt. 17, New York, N.Y. 10016

[21] Appl. No.: 155,437

[22] Filed: Jun. 2, 1980

[51] Int. Cl.[3] ..... A47C 27/14; A47C 17/04

[52] U.S. Cl. ..... 5/465; 5/12 R; D6/4; D6/37; D6/201; D6/204

[58] Field of Search ..... 5/12 R, 51 B, 465, 437; 297/118, 440; D6/61, 4, 37, 201, 204

[56] References Cited

U.S. PATENT DOCUMENTS

| | | | |
|---|---|---|---|
| D. 142,685 | 10/1945 | Zinkel | 5/465 |
| D. 242,304 | 11/1976 | Petersilie | D6/4 |
| D. 252,487 | 7/1979 | Petersilie | D6/63 |
| 1,271,496 | 7/1918 | Wilson | 5/465 |
| 1,549,289 | 8/1925 | Bradley | 5/465 |
| 2,589,579 | 3/1952 | Slayen | 5/465 |
| 2,693,847 | 11/1954 | Kablotsky | 5/465 |
| 3,469,882 | 9/1969 | Larsen | 5/465 |
| 3,555,581 | 1/1971 | Friant | 5/465 |
| 3,751,739 | 8/1973 | Assmann | 5/12 R |
| 3,890,658 | 6/1975 | Petersilie | 5/12 R |
| 3,902,759 | 9/1975 | Monteforte et al. | 5/12 R |
| 3,968,529 | 7/1976 | Levin et al. | 5/437 |

FOREIGN PATENT DOCUMENTS

| | | |
|---|---|---|
| 669460 | 12/1965 | Belgium . |
| 2212332 | 9/1973 | Fed. Rep. of Germany . |
| 114920 | 4/1918 | United Kingdom . |
| 434780 | 5/1934 | United Kingdom . |

*Primary Examiner*—Ramon S. Britts
*Assistant Examiner*—Alexander Grosz
*Attorney, Agent, or Firm*—Steven J. Hultquist

[57] ABSTRACT

A cushion member of uniform thickness having a rectangular shape in plan view, with a center line of the cushion member dividing same into two plan view square portions. The cushion member is segmented into four isosceles right triangular sections arranged such that the two sections bounding the center line coextensively abut along their corresponding legs and the two sections in each square portion coextensively abut one another along their hypotenuses, with the respective lines of abutment of the sections in the square portions intersecting at right angles. The segments are hingedly joined together. On one rectangular face of the cushion member the two sections bounding the center line are hingedly joined in the plane of the one rectangular face. On the other rectangular face, the two sections in each square portion are hingedly joined in the plane of the other rectangular face. Such construction permits the segmented cushion member to be pivotally folded at its hinged joints and thereby to assume multiple furniture configurations.

6 Claims, 10 Drawing Figures

UNITARY FURNITURE ELEMENT

BACKGROUND OF THE INVENTION

1. Field of the Invention

This invention relates to a unitary furniture element which is convertible to form multiple furniture configurations.

2. Brief Description of the Prior Art

In the field of convertible furniture design, a great many designs have evolved for furniture modules and unitary furniture elements which by specific translational and rotational movements of their segments or parts relative to one another are able to form multiple furniture configurations and/or compacted configurations for transportation and storage of the furniture unit. For example, U.S. Pat. Nos. 1,549,289 and 2,589,579, U.S. Design Pat. No. 142,685, and Belgian Pat. No. 669,460 all disclose mattresses or cushion members having square or rectangular segments hingedly joined together, with the respective segments being foldable to form a compact stacked array for transportation, storage, or use as an additional furniture configuration, e.g., a hassock or seat. In addition, the cushion member disclosed in the last-mentioned Belgian Pat. No. 669,460 is segmented, with its respective segments being hingedly joined together so that the cushion member is modifiable into a single-backed or double-backed seat arrangement.

U.S. Pat. No. 3,902,759 discloses a convertible easy chair structure formed by an array of upholstered cushion members, each of parallelepiped configuration. Adjacent cushion members in the array are connected by their coverings. By unfolding the easy chair structure to fully longitudinally extend the cushion member array, a furniture configuration is formed which is utilizable as a bed or couch. The same cushion member array, when only partially longitudinally extended, can be folded to form a lounge chair.

U.S. Pat. No. 3,890,658 discloses a fold-open convertible furniture unit which converts from a folded-closed couch or chair configuration to a folded-open bed or ottoman. In the folded-closed couch configuration, the furniture unit has a semi-circular seat body surrounded by a semi-circular side portion circumferentially coextensive with the seat body. The side portion is hingedly joined at its extremeties with an arcuate back portion which, when folded closed, congruently and coextensively abuts the side portion. The furniture unit also comprises two hassock or seat bodies in the form of sectors, each having a 90° arc length, which mate with each other and with the aforementioned semi-circular seat body to form an integral body of circular shape. In the conversion to the bed or ottoman, the arcuate back portion of the couch or chair configuration is folded open to enclose the mated sectorial bodies. By such rearrangement a unit of furniture is formed which, being flat on its upper surface and circular in shape in plan view, may then be suitably utilized as a bed or ottoman. A similar furniture unit is shown in U.S. Design Pat. No. 242,304.

U.S. Design Pat. No. 252,487 discloses a convertible sofa-bed, in the sofa configuration of which upstanding back and side arm portions enclose a two-layer cushion assembly. The respective layers of such cushion assembly are hingedly joined to one another along their front surfaces, whereby conversion of the sofa to a bed may be effected by pivotally unfolding the top cushion layer so as to longitudinally extend the cushion assembly. By this rearrangement, the surfaces of the respective cushion layers which previously abutted one another in the couch configuration form a continuous horizontal mattress surface for the bed configuration.

U.S. Pat. No. 3,751,759 discloses a furniture unit convertible from an easy chair to a couch. In the chair configuration, cushion segments constituting a seat part and a back are folded against a base and backrest cushion segments, respectively. The various cushion segments are connected together in sequence by cloth hinges. To convert the easy chair configuration to a couch, the portion of the cushion member comprising the seat part and back segments is pivotally unfolded away from the base and backrest segments. The backrest, in turn, is pivotally unfolded from the base, so that when fully unfolded the respective cushion members are generally horizontally aligned to provide an upper surface suitable for sitting or reclining.

Although the above-discussed convertible furniture provides a number of distinct furniture configurations and is generally readily convertible from existing use to storage and/or other furniture configurations, there is still a need for a furniture element which is highly compact, which is storable in the room in which the furniture configurations of the element are deployed, and which is highly versatile, i.e., modifiable to form an extensive number of distinct furniture configurations.

Accordingly, it is an object of the present invention to provide a unitary furniture element which is highly compact in character, which is able to be stored aesthetically in the room in which the various furniture configurations of the element are employed and utilized as a furniture element in such "stored" form, which is inexpensive to manufacture, and which is highly versatile with respect to the number of distinct furniture configurations that may be formed from the element.

Other objects and advantages of this invention will be apparent from the ensuing disclosure and appended claims.

SUMMARY OF THE INVENTION

The unitary furniture element of this invention comprises a segmented cushion member of uniform thickness having in plan view a rectangular shape with a length of twice its width, with a center line of the cushion member dividing same into two square portions in plan view. The cushion member is segmented into four isosceles right triangular sections arranged such that the two sections bounding the center line coextensively abut along their corresponding legs, and the two sections in each square portion coextensively abut one another along their hypotenuses such that the respective lines of abutment of the sections in the square portions intersect at right angles. The segments are hingedly joined such that on one rectangular face of the cushion member the two sections bounding the center line are hingedly joined in the plane of the one rectangular face and on the other rectangular face, the two sections in each square portion are hingedly joined in the plane of the other rectangular face, whereby the segmented cushion member may be pivotally folded at its hinged joints to assume multiple furniture configurations.

DESCRIPTION OF THE PREFERRED EMBODIMENTS

Figure 1:
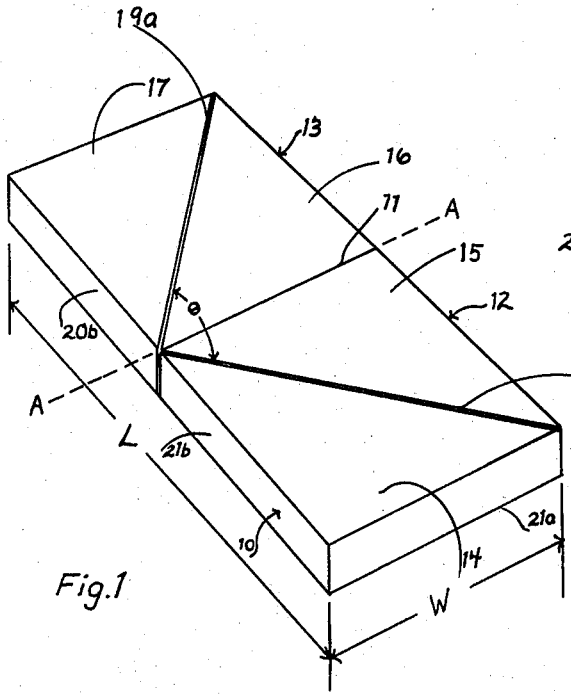
FIG. 1 is an isometric view of the unitary furniture element of this invention as fully longitudinally extended, in which configuration the furniture element may suitably be used as a mattress.

Referring now to the drawings, FIG. 1 is an isometric view of the unitary furniture element of this invention, as shown in fully extended form, i.e., the form that such cushion member would have when fully unfolded and resting on a flat ground or floor surface. The segmented cushion member 10 is of uniform thickness and has in plan view (i.e., a top view looking downwardly at the cushion member lying on the aforementioned flat ground or floor surface) a rectangular shape with a length L of twice its width W. A center line A—A of the cushion member divides same into two square portions 12, 13 in plan view. The cushion member 10 is segmented into four isosceles right triangular sections 14, 15, 16 and 17, arranged such that the two sections 15, 16 bounding the center line A—A coextensively abut along their corresponding legs, i.e., the corresponding legs of triangular section 15, 16 which mate at the center line A—A. The two triangular sections in each square portion, sections 14 and 15 in square portion 12 and sections 16 and 17 in square portion 13, coextensively abut one another along their hypotenuses such that the respective lines of abutment of the sections in the square portions intersect at right angles, as shown in FIG. 1 by angle $\theta$ (=90°) as the included angle between the respective lines of abutment 18*a*, 19*a* of the sections in the square portions. The segments in the cushion member are hingedly joined such that on one rectangular face of the cushion member, viz., the top rectangular face as shown in FIG. 1, the two sections bounding the center line A—A are hingedly joined in the plane of the one rectangular face. As used herein, "one rectangular face" and "other rectangular face" refer respectively to the generally planar surfaces of the cushion member in FIGS. 1 and 2 that one would view in plan view, looking downwardly on the cushion member as disposed on a flat ground or floor surface. Thus, the top rectangular face of the cushion member as shown in FIG. 1 corresponds to the "one rectangular face", and the top rectangular face of the cushion member as shown in FIG. 2 constitutes the "other rectangular face."

For ease of identification in the ensuing discussion of the drawings, the side surfaces of the triangular segments in the FIG. 1 drawing have been numbered. Thus, as shown, triangular segment 14 has side surfaces, or legs, 21*a* and 21*b*. Correspondingly, triangular section 17 has side surfaces, or legs, 20*a* (not shown) and 20*b*. These triangular segments 14 and 17 are identified hereinafter as "outer triangular sections"; they coextensively abut adjacent triangular sections only along their respective hypotenuses, in contrast to the other triangular sections 15, 16, which bound the center line of the cushion member along corresponding legs as well as abutting the outer triangular sections along their respective hypotenuses.

Figure 2:
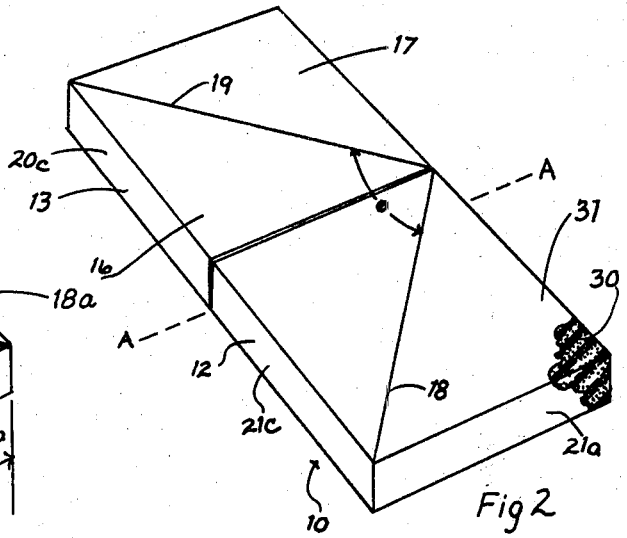
FIG. 2 is an isometric view of the furniture element, showing the opposite rectangular face from that shown in FIG. 1.

FIG. 2 is an isometric view of the reverse side of the cushion member as shown in FIG. 1. As shown in FIG. 2, there is a gap on the reverse side of the cushion member along the line of abutment 11*a* between the abutting legs of triangular sections 15 and 16. Such gap is associated with the fact that, as previously discussed in connection with FIG. 1, the two sections 15, 16 bounding the center line A—A are hingedly joined in the plane of the one rectangular face, along the hinge joint seam 11. Such joint arrangement allows the cushion member to be pivotally folded at its center line hinge joint 11, as discussed more fully hereinafter. The two triangular sections in each square portion of the cushion member are hingedly joined in the plane of the other rectangular face, along the hinge joint seams 18, 19. Such hypotenusal hinge joints are constructed similarly to the center line hinge joint 11, so that the hypotenusal hinge joints 18, 19 have associated therewith gaps extending to the opposite rectangular face of the cushion member, giving rise to the gaps associated with lines of abutment 18*a* and 19*a*, as shown in FIG. 1 between the triangular sections in the respective square portions of the cushion member. In addition, FIG. 2 shows the side surfaces, or legs, 20*c*, 21*c* of the triangular sections 16, 15 respectively.

In a preferred mode of construction, each of the triangular sections of the cushion member comprises an interior body 30 of flexible, resilient material having the approximate shape and thickness of the triangular section. The interior bodies of the triangular sections are enclosed by coverings 31 arranged such that the hinge joints are formed by seams joining opposed layers of the coverings along the center line and the square portion hypotenusal lines of the cushion member. In practice, the flexible resilient material 30 may be a polymeric foam material such as polyurethane foam and the coverings may be suitably formed of (cloth) fabric, leather or flexible polymeric materials. Preferably the coverings comprise two discreet sections, each associated with one of the rectangular faces of the cushion member so as to cover same, with one of the covering sections being joined to the other covering section to enclose the interior bodies of the triangular sections and to form the hinge joint seams.

Figure 3:
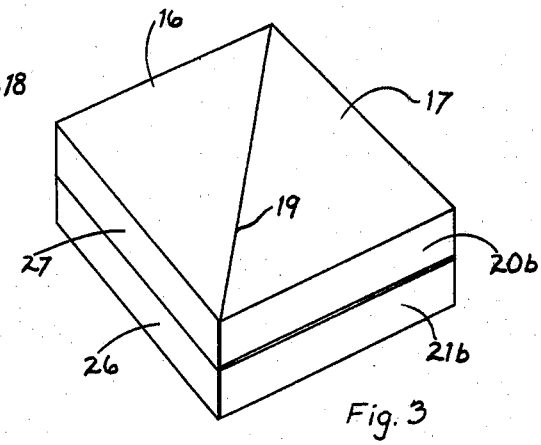
FIG. 3 is a view of the furniture element in a mattress or seat configuration, as formed by pivotally folding the cushion member about its center line hinge joint.

FIG. 3 is an isometric view of the folded cushion member in a configuration suitable for use as a mattress, seat or the like. Such configuration is formed by pivotally folding the cushion member about its center line hinge joint 11, such that when fully folded the surfaces of the two square portions originally in the plane of the one rectangular face of the cushion member congruently abut one another. In this configuration, the sides or legs 26, 27 of the triangular sections 15, 16 bounding the center line A—A of the cushion member as shown in FIG. 1 are exposed and vertically aligned with one another.

Figure 4:
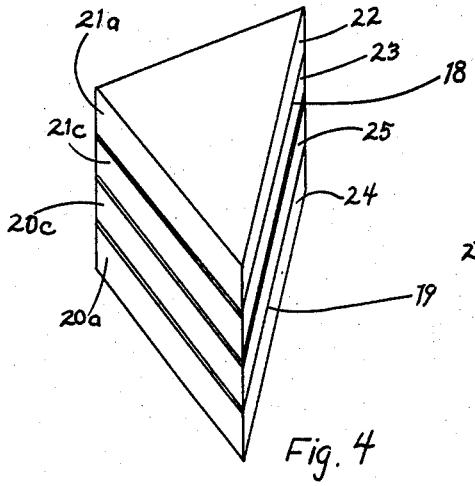
FIG. 4 is a view of the furniture element in a seat or hassock configuration, as formed by fully folding the cushion member so that the triangular sections thereof are congruently stacked in an array.
Figure 7:
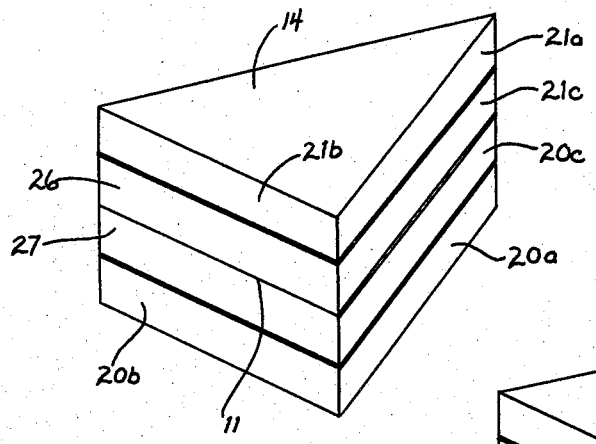
FIG. 7 is a view of the cushion member configuration of FIG. 4, showing the back side thereof.

FIG. 4 shows an isometric view of the folded cushion member, as providing a configuration suitable for use as a seat, hassock, or the like. This configuration is formed by pivotally folding the cushion member along its center line hinge joint and its hypotenusal hinge joints such that the successive triangular sections of the cushion member are sequentially and congruently stacked on top of one another in abutting relationship as a stacked array. FIG. 7 shows a view of the back side of the FIG. 4 stacked array.

Figure 5:
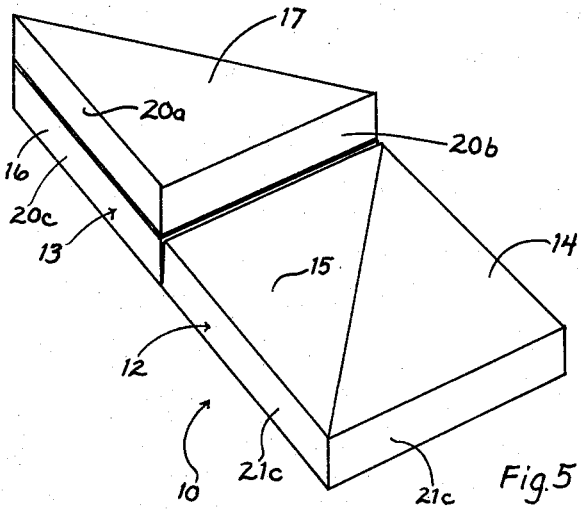
FIG. 5 is a view of the cushion member in a mattress with head rest, or seat configuration, as formed by pivotally folding the cushion member along the hypotenusal hinge joint of one of the square portions thereof.

FIG. 5 is a view of a furniture configuration suitable for use as a mattress with a head rest, as a seat or the like. This configuration is formed by pivotally folding the cushion member along the hypotenusal hinge joint 19 of the square portion 13, such that when fully folded the surfaces of the triangular sections 16, 17 of square portion 13, which were originally in the plane of the other rectangular face of the cushion member, congruently abut one another.

Figure 6:
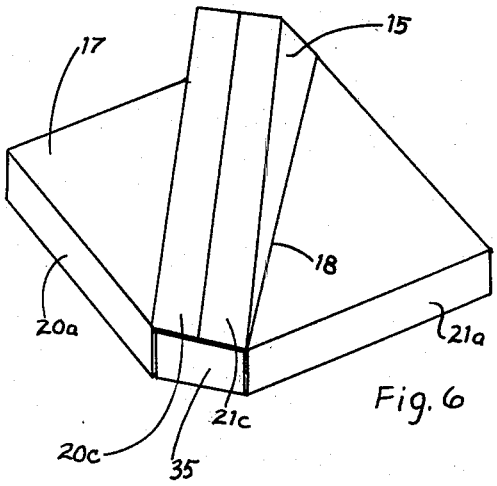
FIG. 6 is a view of a back-to-back seat configuration of the cushion member, as formed by pivotally fully folding the cushion member along its center line hinge joint and partially folding the cushion member square portions along their hypotenusal hinge joints, with the diagonally extending void space formed by such folding accommodating an inserted reinforcing member to rigidify the configuration.

FIG. 6 shows a configuration of the cushion member suitable for use as a back-to-back seat or the like. Such configuration is formed by pivotally fully folding the cushion member along its center line hinge joint 11 and partially folding the cushion member square portions 12, 13 along their hypotenusal hinge joints 18, 19, such that the surfaces of the triangular sections 15, 16 bounding the center line and originally in the plane of the one rectangular face of the cushion member congruently abut one another. The abutted triangular sections 15, 16 are oriented perpendicularly with respect to the outer triangular sections 14, 17, with the surfaces of the outer triangular section originally in the plane of the other rectangular face of the cushion member being retained in such plane. If desired, this configuration of the cushion member may be rigidified, i.e., be made structurally more rigid and stable, by insertion of a reinforcing member 35, in the form of a parallelepiped having a rectangular cross-section, into the diagonally extending void space formed between outer triangular sections 14, 17 and beneath the triangular sections 15, 16 coextensively abutting one another. The reinforcing member 35 may be constructed in the same manner as the cushion member, with an interior body of flexible resilient material enclosed by coverings. Alternatively, and by way of example only, the reinforcing member may comprise a body formed of wood, plastic or other generally solid material.

Figure 8:
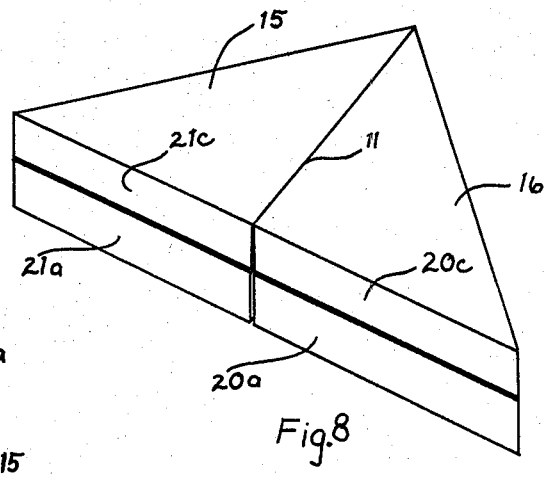
FIG. 8 is a view of the cushion member in a seat configuration, as formed by pivotally folding the cushion member along both of its hypotenusal hinge joints.

FIG. 8 shows a furniture configuration suitable for use as a seat or the like. Such configuration is formed by pivotally folding the cushion member along both of its hypotenusal hinge joints 18, 19 such that when fully folded, the surface of each of the triangular sections 14, 17 originally in the plane of the other rectangular face of the cushion member abuts the surface of its adjacent triangular section, 15, 16, in such plane.

Figure 9:
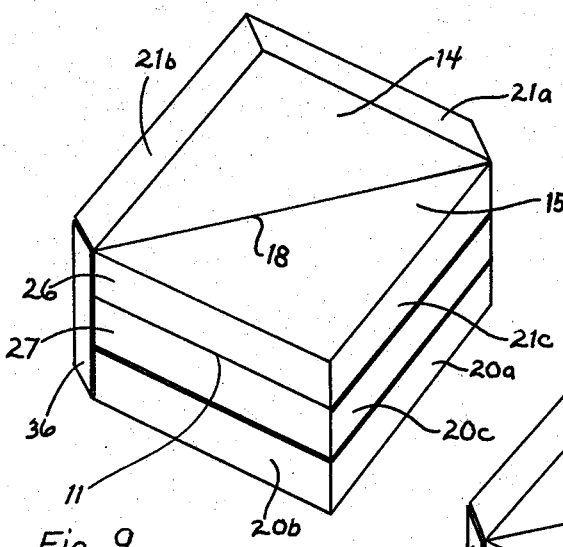
FIG. 9 is a view of the cushion member in a configuration similar to that shown in FIG. 7, but with the uppermost triangular section unfolded such that same is oriented perpendicularly with respect of the orientation of the other triangular sections in the stacked array, and with the configuration rigidified when the folded cushion member is placed against a wall member, by abuttingly positioning a rectangular reinforcing member behind the stacked array and supportingly beneath the uppermost triangular section.

FIG. 9 shows a seat or the like, as formed initially in accordance with the embodiment of FIGS. 4 and 7. Subsequent to the formation of the stacked array shown in FIGS. 4 and 7, the uppermost triangular section 14 is pivotally, upwardly and partially unfolded along its hypotenusal hinge joint 18 such that the uppermost triangular section is oriented perpendicularly with respect to the orientation of the other triangular sections disposed in abutting relationship in the stacked array. This configuration can also be rigidified, such as may be desirable when the folded cushion member is placed against a flat wall surface with the back side of the partially unfolded, uppermost triangular section 14 in abutting relationship therewith, to provide a back and head rest when the configuration is used as a seat. The means for such rigidification comprise a rectangular reinforcing member 36 which is abuttingly positioned behind the stacked array and supportingly beneath the partially unfolded, uppermost triangular section 14, as shown in FIG. 9.

Figure 10:
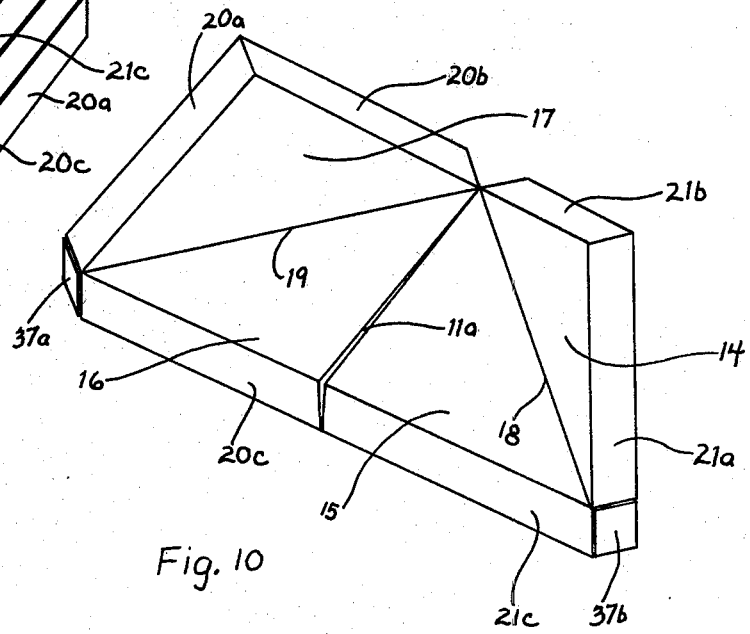
FIG. 10 is a view of the cushion member in a seat configuration, as formed by pivotally and partially folding the cushion member along its hypotenusal hinge joints such that the outer triangular sections are oriented perpendicularly with respect to the triangular sections bounding the center line of the cushion member, with the configuration rigidified when the folded cushion member is placed against a wall member, by abuttingly positioning parallelepiped-shaped reinforcing members of square cross-section behind the unfolded triangular sections and supportingly beneath the partially folded triangular sections.

FIG. 10 shows a folded cushion member furniture configuration which is suitable for use as a seat or the like. Such configuration is formed by pivotally and partially folding the cushion member along its hypotenusal hinge joints 18, 19, such that the outer triangular sections 14, 17 are oriented perpendicularly at the completion of folding with respect to the triangular sections 15, 16 bounding the center line 11 of the cushion member. This configuration may in practice be suitably positioned in a room corner, with the upwardly extending triangular sections 14, 17 of the partially folded cushion member disposed abuttingly against the intersecting wall surfaces defining the corner. Such configuration may be rigidified by abuttingly positioning the parallelepiped-shaped reinforcing members 37*a*, 37*b* of square cross-section behind the unfolded triangular sections 15, 16 and supportingly beneath the partially folded triangular sections 14, 17.

It will be appreciated from the foregoing that certain of the above-described configurational embodiments of the invention are particularly suited for placement in corners and corner areas of rooms in homes and offices, by virtue of their right triangular perimetral geometry which allows such embodiments to be positioned snugly against the intersecting walls at the corner of a room. Such embodiments include the configurations of FIGS. 3, 4, 6, 7, 8 and 10. When the cushion member is not in use as a chair, cushion, mattress, seat or the like, the same may be fully folded into the configuration shown in FIGS. 4 and 7 and placed unobtrusively in a corner of the room in which the cushion member is otherwise utilized, thereby preserving the aesthetic appearance of such room. The fully folded configuration of FIGS. 4 and 7 is highly compact and readily transportable to the desired location of use.

Although preferred embodiments have been described in detail, it will be appreciated that other embodiments are contemplated with modification of the disclosed features, as being within the scope of the invention.

What is claimed is:

1. A unitary furniture element comprising a segmented cushion member of uniform thickness having in plan view a rectangular shape with a length of twice its width, with a center line of the cushion member dividing same into two square portions in plan view, the cushion member being segmented into four isosceles right triangular sections arranged such that the two sections bounding the center line coextensively abut along their corresponding legs and the two sections in each square portion coextensively abut one another along their hypotenuses such that the respective lines of abutment of the sections in the square portions intersect at right angles, the sections being hingedly joined such that on one rectangular face of the cushion member the two sections bounding the center line are hingedly joined in the plane of the one rectangular face and on the other rectangular face, the two sections in each square portion are hingedly joined in the plane of the other rectangular face, whereby the segmented cushion member may be pivotally folded at its hinged joints to assume multiple furniture configurations.

2. A unitary furniture element according to claim 1 wherein the pivotally folded cushion member describes one of the following furniture configurations:

(a) a mattress, seat or the like, as formed by pivotally folding the cushion member about its center line hinge joint such that when fully folded the surfaces of the two square portions originally in the plane of the one rectangular face of the cushion member congruently abut one another;

(b) a mattress with headrest, seat or the like, as formed by pivotally folding the cushion member along the hypotenusal hinge joint of one of the square portions thereof such that when fully folded the surfaces of the sections of said one square portion originally in the plane of the other rectangular face of the cushion member congruently abut one another;

(c) a back-to-back seat or the like, as formed by pivotally fully folding the cushion member along its center line hinge joint and partially folding the cushion member square portions along their hypotenusal hinge joints such that the surfaces of the triangular sections bounding the center line and originally in the plane of the one rectangular face of the cushion member congruently abut one another, with the abutted triangular sections being oriented perpendicularly with respect to the outer triangular sections and the surfaces of said outer triangular sections originally in the plane of the other rectangular face of the cushion member being retained in said plane;

(d) a seat, hassock, or the like, as formed by pivotally folding the cushion member along its center line hinge joint and its hypotenusal hinge joints such that the successive triangular sections of the cushion member are sequentially and congruently stacked on top of one another in abutting relationship as a stacked array;

(e) a seat or the like, as formed by pivotally folding the cushion member along both of its hypotenusal hinge joints such that when fully folded the surface of each of the outer triangular sections originally in the plane of the other rectangular face of the cushion member abuts the surface of its adjacent triangular section in said plane;

(f) a seat or the like, as formed initially according to (d), wherein the uppermost triangular section is pivotally, upwardly and partially unfolded along its hypotenusal hinge joint such that same is oriented perpendicularly with respect to the orientation of the other triangular sections as disposed in abutting relationship in the stacked array; and (g) a seat or the like, as formed by pivotally and partially folding the cushion member along its hypotenusal hinge joints such that the outer triangular sections are oriented perpendicularly at the completion of folding with respect to the triangular sections bounding the center line of said cushion member.

3. A unitary furniture element according to claim 1 wherein each of said triangular sections comprises an interior body of flexible, resilient material having the approximate shape and thickness of the triangular section, said interior bodies of said triangular sections being enclosed by coverings arranged such that said hinge joints are formed by seams joining opposed layers of said coverings along the center line and the square portion hypotenusal lines of the cushion member.

4. A unitary furniture element according to claim 3 wherein said flexible resilient material is a polymeric foam material and said coverings are formed of a material selected from the group consisting of fabric, leather, and flexible polymeric materials.

5. A unitary furniture element according to claim 4 wherein said flexible, resilient material is polyurethane foam and said coverings are formed of fabric.

6. A unitary furniture element according to claim 3 wherein said coverings comprise two discrete sections each associated with one of said rectangular faces of said cushion member so as to cover same and joined to the other covering section to enclose said interior bodies of said triangular sections and to form said hinge joint seams.

* * * * *

UNITED STATES PATENT AND TRADEMARK OFFICE

CERTIFICATE OF CORRECTION

PATENT NO. : 4,293,965

DATED : October 13, 1981

INVENTOR(S) : Margaret C. Hrubec

It is certified that error appears in the above—identified patent and that said Letters Patent is hereby corrected as shown below:

Delete the title page and substitute the attached page therefor.

Signed and Sealed this

*Thirtieth* Day of *March 1982*

[SEAL]

*Attest:*

GERALD J. MOSSINGHOFF

*Attesting Officer*

*Commissioner of Patents and Trademarks*

United States Patent [19]

Hrubec

[11] 4,293,965

[45] Oct. 13, 1981

[54] UNITARY FURNITURE ELEMENT

[76] Inventor: Margaret C. Hrubec, 220 E. 27th St., Apt. 17, New York, N.Y. 10016

[21] Appl. No.: 155,437

[22] Filed: Jun. 2, 1980

[51] Int. Cl.[3] ..... A47C 27/14; A47C 17/04

[52] U.S. Cl. ..... 5/465; 5/12 R; D6/4; D6/37; D6/201; D6/204

[58] Field of Search ..... 5/12 R, 51 B, 465, 437; 297/118, 440; D6/61, 4, 37, 201, 204

[56] References Cited

U.S. PATENT DOCUMENTS

| | | | |
|---|---|---|---|
| D. 142,685 | 10/1945 | Zinkel | 5/465 |
| D. 242,304 | 11/1976 | Petersilie | D6/4 |
| D. 252,487 | 7/1979 | Petersilie | D6/63 |
| 1,271,496 | 7/1918 | Wilson | 5/465 |
| 1,549,289 | 8/1925 | Bradley | 5/465 |
| 2,589,579 | 3/1952 | Slayen | 5/465 |
| 2,693,847 | 11/1954 | Kablotsky | 5/465 |
| 3,469,882 | 9/1969 | Larsen | 5/465 |
| 3,555,581 | 1/1971 | Friant | 5/465 |
| 3,751,739 | 8/1973 | Assmann | 5/12 R |
| 3,890,658 | 6/1975 | Petersilie | 5/12 R |
| 3,902,759 | 9/1975 | Monteforte et al. | 5/12 R |
| 3,968,529 | 7/1976 | Levin et al. | 5/437 |

FOREIGN PATENT DOCUMENTS

| | | |
|---|---|---|
| 669460 | 12/1965 | Belgium . |
| 2212332 | 9/1973 | Fed. Rep. of Germany . |
| 114920 | 4/1918 | United Kingdom . |
| 434780 | 5/1934 | United Kingdom . |

*Primary Examiner*—Ramon S. Britts
*Assistant Examiner*—Alexander Grosz
*Attorney, Agent, or Firm*—Steven J. Hultquist

[57] ABSTRACT

A cushion member of uniform thickness having a rectangular shape in plan view, with a center line of the cushion member dividing same into two plan view square portions. The cushion member is segmented into four isosceles right triangular sections arranged such that the two sections bounding the center line coextensively abut along their corresponding legs and the two sections in each square portion coextensively abut one another along their hypotenuses, with the respective lines of abutment of the sections in the square portions intersecting at right angles. The segments are hingedly joined together. On one rectangular face of the cushion member the two sections bounding the center line are hingedly joined in the plane of the one rectangular face. On the other rectangular face, the two sections in each square portion are hingedly joined in the plane of the other rectangular face. Such construction permits the segmented cushion member to be pivotally folded at its hinged joints and thereby to assume multiple furniture configurations.

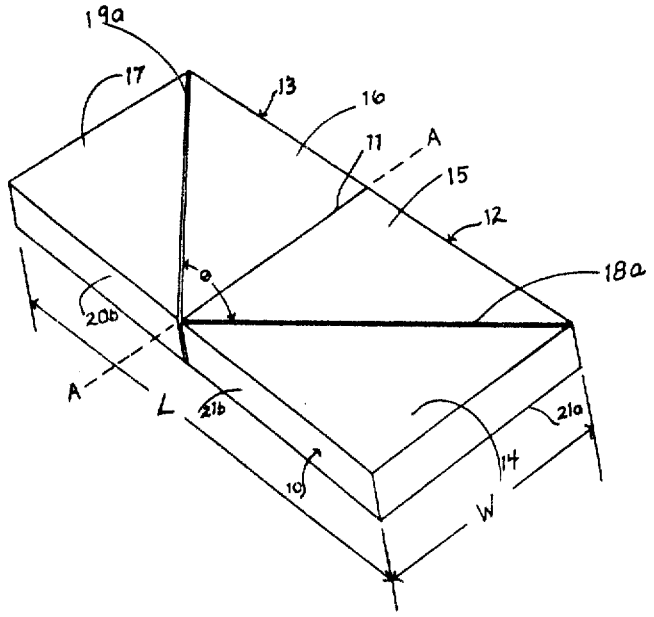

6 Claims, 10 Drawing Figures